United States Patent [19]

Compton et al.

[11] Patent Number: 4,850,422

[45] Date of Patent: Jul. 25, 1989

[54] METHOD OF CASTING ALUMINUM

[75] Inventors: Carl L. Compton; James D. Newman, both of Florence, Ala.

[73] Assignee: Reynolds Metals Company, Richmond, Va.

[21] Appl. No.: 851,276

[22] Filed: Apr. 10, 1986

Related U.S. Application Data

[63] Continuation of Ser. No. 757,266, Jul. 22, 1985, abandoned.

[51] Int. Cl.[4] ..... B22D 11/07

[52] U.S. Cl. ..... 164/473; 164/472

[58] Field of Search ..... 164/473, 55.1, 56.1, 164/472, 122, 459

[56] References Cited

U.S. PATENT DOCUMENTS

| | | | |
|---|---|---|---|
| Re. 26,969 | 10/1970 | O'Shea | 164/72 |
| 1,662,354 | 3/1928 | Williams . | |
| 1,982,762 | 12/1934 | Russell et al. | 22/200 |
| 1,982,763 | 12/1934 | Russell et al. | 22/192 |
| 2,128,327 | 8/1938 | Russell et al. | 22/65 |
| 3,245,126 | 4/1966 | Phillips et al. | 22/200.1 |
| 3,338,296 | 8/1967 | Craig | 164/89 |
| 3,342,249 | 9/1967 | Ulmer et al. | 164/72 |
| 3,817,312 | 6/1974 | Niimi et al. | 164/72 |
| 3,964,916 | 6/1976 | Armistead | 164/472 |
| 4,150,708 | 4/1979 | Patton et al. | 164/72 |
| 4,202,523 | 5/1980 | Radtke | 249/115 |
| 4,264,052 | 4/1981 | Radtke et al. | 249/115 |
| 4,312,400 | 2/1982 | Carini | 164/472 |
| 4,340,426 | 7/1982 | Tabei | 164/473 |
| 4,425,411 | 1/1984 | Textor et al. | 428/702 |

*Primary Examiner*—Richard K. Seidel

*Attorney, Agent, or Firm*—Alan T. McDonald

[57] ABSTRACT

A method for improving the quality of aluminum ingots or billets formed by the direct chill method comprises applying a small amount of an insulating, nonreactive powder to the surface of the molten metal.

8 Claims, 1 Drawing Sheet

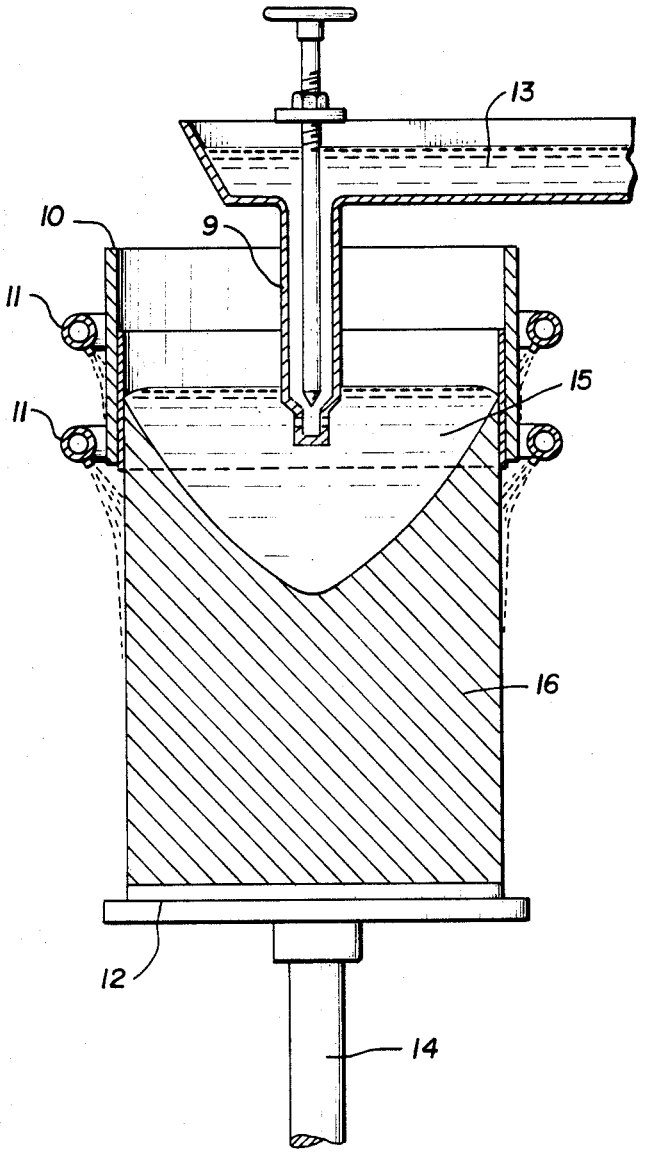
13
10
9
11
15
11
16
12
14

METHOD OF CASTING ALUMINUM

This application is a continuation of application Ser. No. 757,266 filed July 22, 1985, now abandoned.

BACKGROUND OF THE INVENTION

Aluminum and aluminum alloy ingots and billets are routinely formed by the direct chill (DC) casting process. In this process, molten metal is fed to a mold having a bottom portion thereof which is lowered as the metal solidifies, forming the ingot or billet from a molten pool of metal at the top of the mold. Solidification of the molten metal results from water spray cooling of the mold and the outer surface of the metal ingot or billet.

The DC casting method is not without its limits. Surface cracks and other surface imperfections require that a significant portion of the outer surface of the ingot or billet be removed or scalped from the ingot or billet after casting and prior to rolling or extrusion into a final product.

With certain aluminum alloys, notably the relatively hard aluminum can body stock alloys, such as aluminum alloy 5182, these surface irregularities are often pronounced. It is evident from close examination of finished ingots of this material that a major cause of the surface irregularities comes from the metal solidifying in a series of horizontal layers, rather than in a continuous vertical freeze pattern. This requires even more extensive scalping of the ingots, resulting in excessive scrap.

Another common surface characteristic of ingots formed from alloys such as aluminum alloy 5182 is a darkened surface appearance, referred to as a black ingot.

Other surface defects in aluminum ingots and billets as they are formed by the DC casting method include tearing of the surface resulting from sticking of the surface of the ingot to th-e surface of the mold.

In the past, various lubrication schemes have been attempted to improve aluminum ingot and billet casting surface quality. Such methods as coating the mold surface with a release agent prior to casting, supplying a soluable oil to the mold during casting and applying carbon powder to the molter metal surface of the ingot during casting have met with mixed results.

It is desirable, therefore, to provide an improved method for direct chill casting of aluminum and aluminum alloy ingots and billets which will substantially reduce or eliminate surface cracks, tearing, and other surface defects, such as black ingots, so that reduced levels of scalping prior to final forming are required.

THE PRESENT INVENTION

By means of the present invention, this desirable result has been obtained.

The method of the present invention involves applying to the molten metal surface of an aluminum or aluminum alloy ingot or billet being cast an insulating and nonreactive powder selected from the group consisting of boron nitride, amorphous silica, diatomaceous earth and talcum. The powder migrates to the edges and corners of the mold, resulting in reduced levels of tearing and surface cracking, reduction in or elimination of black surface ingots and solidification of the ingot in a vertical direction, rather than as horizontal layers.

The resulting ingot or billet is more easily scalped, with less metal having to te removed and scraped from the ingot or billet.

BRIEF DESCRIPTION OF THE DRAWING

The method of the present invention will be more fully described with reference to the drawing in which the FIGURE is a diagramatic representation of the direct chill casting of an aluminum alloy ingot.

DETAILED DESCRIPTION OF THE PREFERRED EMBODIMENTS

Turning now to the FIGURE, a convention ingot forming operation is illustrated in which an open-ended mold 10, associated with coolant providing pipes 11, is mounted in fixed position over a platform 12 which is attached to and supported on a lowering device 14. The platform 12 initially forms the bottom of mold 10, but once the casting process is started the platform 12 is lowered as the ingot 16 is formed, allowing withdrawal of the ingot 16 from the mold at the rate it is formed, or its shell is formed, therein. It should be understood that the term ingot as referred to herein comprises both generally rectangular ingots and generally cylindrical billets. In the FIGURE, the casting is shown in progress, with the molten metal 13 being fed to th operation through a spout 9 and at a rate which, taking into account the coolant, the rate of solidification, and the lowering rate of platform 12, maintains a relatively constant level, or head, 15 of molten aluminum in the mold 10 and above ingot 16. It is also known to eliminate the spout 9, with the mold 10 in such a case being directly fed from the wall of a furnace or other molten metal container.

According to the practice of the present invention, a small quantity, ranging, for example, from about 10 to about 100 grams, of a fine, insulating, nonreacting powder selected from the group consisting of-boron nitride, amorphous silica, diatomaceous earth and talcum is introduced onto the surface of the molten metal 15 in the mold 10 at the beginning of the drop or casting operation, i.e., when platform 12 forms the bottom of mold 10. The powder may be introduced by sprinkling it onto the surface of metal 15, or, for example, by aspersion from a squeeze bottle. The powder may be introduced onto the entire molten metal surface, or may be applied to the edges and/or corners of the mold 10.

Once in place, the powder promotes a stable meniscus to the molten metal head 15, promotes stable heat transfer and results in vertical, rather than horizontal, solidification of the ingot 16.

The powder may be, for example, of about −325 mesh. When boron nitride powder is employed, the boron nitride powder may be from about 90 to about 99 percent by weight boron nitride, with the remainder being largely boron oxide. Likewise, when amorphous silica, diatomaceous earth, or talcum powder is employed, purity from about 90 percent is acceptable.

While the method of the present invention may be of benefit to numerous aluminum alloy compositions, it has been found to be exceptionally effective when employed in casting relatively hard aluminum alloy compositions, such as aluminum alloy 5182, which alloy is typically employed as aluminum can body stock. When employed with alloy 5182, the method of the present invention not only promotes vertical solidification of the ingot, reduced surface cracking and improved scalping characteristics for the ingot, the method also substantially reduces or eliminates black surface ingots.

From the foregoing, it is clear that the method of the present invention provides a simple, yet effective improvement to the direct chill casting of aluminum and aluminum alloys.

While the invention has been described with reference to certain specific embodiments thereof, it is not intended to be so limited thereby, except as set forth in the accompanying claims.

We claim:

1. In a method of casting molten aluminum or aluminum alloys into ingot or billet by providing an open-ended mold, continuously feeding said molten aluminum or aluminum alloy into said mold and withdrawing heat of solidification from said aluminum or aluminum alloy to effect in said mold at least partial solidification of said ingot or billet, and continuously withdrawing said ingot or billet from said mold the improvement comprising applying to the surface of the molten aluminum or aluminum alloy an insulating and nonreacting powder selected from the group consisting of boron nitride, amorphous silica, diatomaceous earth and talcum in a single application at the beginning of said casting and without any further application of said powder during the remainder of said casting.

2. The method of claim 1 wherein said powder is applied in an amount ranging between about 10 and 100 grams.

3. The method of claim 1 wherein said powder has the purity of at least about 90 percent.

4. The method of claim 1 wherein said powder has a size of about −325 mesh.

5. The method of claim 1 wherein said aluminum alloy is 5182.

6. The method of claim 1 wherein said powder is applied to the entire surface of said molten metal.

7. The method of claim 1 wherein said powder is applied to the molten metal at the edges of said mold.

8. The method of claim 1 wherein said powder is applied to said molten metal at the corners of said mold.

* * * * *